US008602843B2

(12) United States Patent
Lunn et al.

(10) Patent No.: US 8,602,843 B2
(45) Date of Patent: Dec. 10, 2013

(54) ABRASIVE MACHINING MEDIA CONTAINING THERMOPLASTIC POLYMER

(75) Inventors: Michael F. Lunn, Adamsburg, PA (US); Daniel P. Troup, Greensburg, PA (US); Robert A. Miller, Rillton, PA (US); David P. Delo, Pittsburgh, PA (US)

(73) Assignee: Kennametal Inc., Latrobe, PA (US)

( * ) Notice: Subject to any disclaimer, the term of this patent is extended or adjusted under 35 U.S.C. 154(b) by 1405 days.

(21) Appl. No.: 11/630,661

(22) PCT Filed: Jul. 1, 2005 (Under 37 CFR 1.47)

(86) PCT No.: PCT/US2005/023510

§ 371 (c)(1), (2), (4) Date: Jan. 18, 2010

(87) PCT Pub. No.: WO2006/007554

PCT Pub. Date: Jan. 19, 2006

(65) Prior Publication Data

US 2010/0144247 A1 Jun. 10, 2010

Related U.S. Application Data

(60) Provisional application No. 60/584,590, filed on Jul. 1, 2004.

(51) Int. Cl.
*B24B 1/00* (2006.01)
*C09K 3/14* (2006.01)

(52) U.S. Cl.
USPC ..... 451/36; 51/298; 451/51; 451/61

(58) Field of Classification Search
USPC ..... 51/298, 307, 308, 309; 241/24.17, 241/24.18; 264/319; 451/28, 36, 61, 51
See application file for complete search history.

(56) References Cited

U.S. PATENT DOCUMENTS

| | | | | |
|---|---|---|---|---|
| 3,521,412 | A | 7/1970 | McCarty | |
| 3,819,343 | A | 6/1974 | Rhoades | |
| 4,512,859 | A | 4/1985 | Inoue | |
| 4,849,564 | A | 7/1989 | Shimizu et al. | |
| 4,936,057 | A | 6/1990 | Rhoades | |
| 5,054,247 | A * | 10/1991 | Rhoades et al. | 451/36 |
| 5,184,434 | A * | 2/1993 | Hollinger et al. | 451/36 |
| 5,367,833 | A * | 11/1994 | Rhoades et al. | 451/104 |
| 5,788,558 | A * | 8/1998 | Klein | 451/36 |
| 5,964,644 | A * | 10/1999 | Rhoades | 451/40 |
| 6,099,394 | A | 8/2000 | James et al. | |
| 6,390,890 | B1 | 5/2002 | Molnar | |
| 6,676,486 | B1 * | 1/2004 | Quirke | 451/38 |
| 6,821,359 | B2 * | 11/2004 | Osugi et al. | 148/200 |
| 7,887,608 | B2 * | 2/2011 | Schwabel et al. | 51/307 |
| 2002/0007600 | A1 | 1/2002 | Gilmore et al. | |
| 2002/0187729 | A1 * | 12/2002 | Osugi et al. | 451/28 |
| 2008/0236051 | A1 * | 10/2008 | Schwabel et al. | 51/307 |
| 2009/0191429 | A1 * | 7/2009 | Maeda et al. | 428/696 |

* cited by examiner

*Primary Examiner* — Timothy V Eley
(74) *Attorney, Agent, or Firm* — Matthew W. Smith, Esq.

(57) ABSTRACT

The present invention incorporates at least one thermoplastic or elastomeric polymer in abrasive flow machining media either as the sole or as one of the polymeric constituents. The presence of thermoplastic polymer imparts a greater elastomer characteristic (elasticity, compression resistance, increased relaxation times) as contrasted with traditional media. Enhanced elastomeric characteristics enable more uniform abrasive machining. In a particularly preferred embodiment, silicone- or polyorganosiloxane-based medium contains elastic silicone rubber particles dispersed therethrough to achieve increased relaxation times comparable to those attainable with the inclusion of a thermoplastic polymer.

24 Claims, 1 Drawing Sheet

ABRASIVE MACHINING MEDIA CONTAINING THERMOPLASTIC POLYMER

CROSS-REFERENCE TO RELATED APPLICATIONS

This application claims the benefit of U.S. Provisional Application Ser. No. 60/584,590, filed Jul. 1, 2004, which is hereby specifically incorporated by reference.

BACKGROUND OF THE INVENTION

Field of the Invention

The present invention pertains to improved abrasive media for honing and/or polishing machined, cast and other surfaces. Many types of products, from automotive parts to prosthetic implants, after molding or machining require finishing operations such as polishing of the various formed surfaces. Such polishing is complicated enough when the surface to be honed is easily accessible. When machined, cast, or other parts are complex, the challenges of polishing increase, because the presence of one or more intersecting bores, flats, slots; key ways or splines often produces a sharp corner or a raised burr at the point of conjunction.

Traditional polishing methods originally involved manual filing or sanding or the use of rotary sanding and finishing tools. In addition to the difficulty of conducting sanding operations in the interior or over complex surface features of a fabricated article, both manual and motorized sanding operations required a high level of dexterity by the artisan, the absence of which invariably resulted in erratic performance and unacceptable quality control. Other prior art methods such as vaporblasting, sand blasting, and shot blasting presented their own disadvantages, particularly in that none was of any significant utility in polishing interior fabricated surfaces. Many traditional polishing methods have proved to be extremely labor intensive and therefore very expensive.

In view of the above, a method of honing interior surfaces was subsequently developed in which a material containing abrasive particles suspended therein was passed through interior surfaces of fabricated articles for the purpose of polishing those interior surfaces. Certain media and methods of honing by extruding are disclosed, for example, in U.S. Pat. No. 3,521,412 to McCarty, incorporated herein by reference. Traditionally in the practice of abrasive flow machining (AFM), the medium is comprised of either a silicone rubber composition, or other extrudable materials such as a water-based gel polymer, in a continuum of viscosities ranging from putty-like to near-fluid viscosities. Media of various descriptions have been used in a wide variety of applications, to polish, de-burr, radius, or otherwise to hone such diverse products as automobile intake manifolds, cylinder head intake ports, aircraft compressor and turbine section components, dies for striking currency, and prosthetic implants such as artificial knees and heart valves, without limitation.

Although media used for AFM are in widespread use at this writing, silicone media cannot be used in certain applications and/or is insufficient for use alone in certain applications. For example, there may be concerns about silicone polymers on surfaces which are later to be painted or plated, because the presence of trace amounts of silicone may prevent the adherence of paint products or plating. Guar gum based medium cannot achieve very high viscosities, dries out over time and is not particularly durable. Traditional media are unable to exhibit enhanced elastomeric (elasticity, compression resistance) properties even in high concentrations. Moreover, in many applications traditional AFM media achieves an intensified abrasive action in the vicinity of geometrical restrictions such as a change in cross-sectional area. For example, long, narrow tubes can experience preferential abrasive work near the ends of the tube (i.e., where geometrical transitions exist) creating a condition described as bell-mouth. The elasticity of traditional AFM materials is sufficient to cause some abrasion away from the ends of such a tube but the elasticity is not always sufficient to maintain a consistent degree of abrasion throughout the length of the tube.

A need remains, therefore, for an improved AFM medium useful in a wide range of viscosities and rheological (including elastomeric) properties and suitable for minimizing or eliminating silicone rubber and water-based gel from honing applications where silicone rubber and guar gum are contraindicated, and which is further able to maintain a consistent degree of abrasion throughout the length of the interior geometric surfaces.

SUMMARY OF THE INVENTION

In order to meet this need, the present invention incorporates at least one thermoplastic or elastic polymer in abrasive flow machining media either as the sole or as one of the polymeric constituents. The presence of thermoplastic polymer imparts a greater elastomer characteristic (elasticity, compression resistance) to the medium compared to that of traditional media such as silicone or water-based gel media. Enhanced elastomeric characteristics enable more uniform abrasive machining. For example, in long, narrow tubes media having enhanced elastomeric character can maintain a more uniform radial pressure distribution throughout the length of the tube compared with the distribution realized when using media which does not contain a thermoplastic polymer. Alternatively, at low percentage inclusion and with a significant percentage of mineral oil or other liquid carrier, the thermoplastic polymer abrasive flow medium can be formulated to achieve viscosities significantly lower than those of traditional media for honing applications where a more fluid carrier is preferred. By using the thermoplastic polymer alone as the carrier material, abrasive flow machining processes can be carried out in applications which cannot tolerate the presence of silicone rubber, or the silicone rubber may be enhanced by the additional presence of the at least one thermoplastic polymer. In certain embodiments, the thermoplastic polymer is added to the media in the form of discrete elastomeric particulates, which elastomeric particulates are in many cases the same size or smaller than the abrasive particles coadmixed therewith. In a particularly preferred embodiment, silicone- or polyorganosiloxane-based medium contains elastic silicone rubber particles dispersed therethrough to achieve increased relaxation times comparable to those attainable with the inclusion of a thermoplastic polymer.

DETAILED DESCRIPTION OF THE INVENTION

Figure 1A:
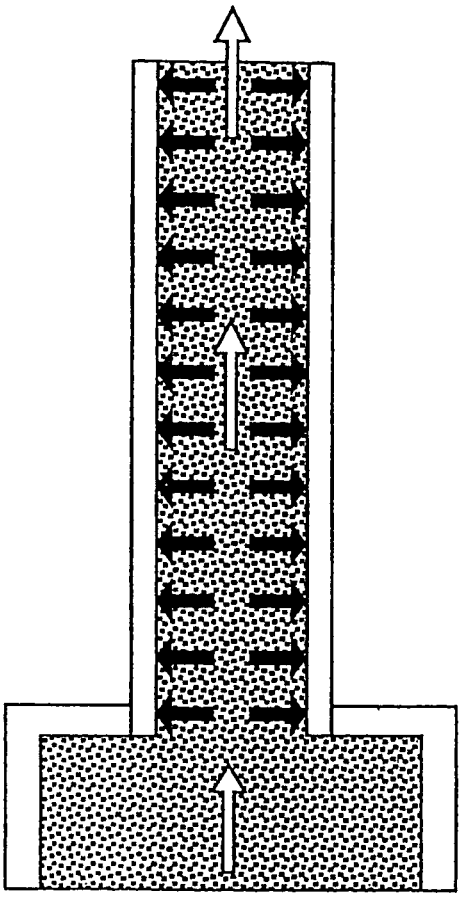
FIG. 1*a* shows the equal forces exerted interior to the length of a tube polished with the present medium.

The present invention pertains to the use of non-silicone thermoplastic or elastic polymer as part or all of the polymer used to provide the medium for honing and polishing applications such as abrasive flow machining and orbital polishing. Although the prior art does not address the inclusion, in abrasive flow machining media, of non-silicone thermoplastic polymer, other aspects of abrasive flow machining media are known and are disclosed in U.S. Pat. No. 3,521,412, U.S. Pat. No. 3,819,343 and U.S. Pat. No. 4,936,057, all incorporated herein by reference.

The present invention incorporates at least one thermoplastic or elastic polymer in abrasive flow machining media either as the sole or as one of the polymeric constituents. The presence of thermoplastic polymer imparts a greater elastomer characteristic (elasticity, compression resistance) to the medium compared to that of traditional media such as silicone or water-based gel media. In other words, the elastomeric constituents enhance the elastic component of the viscoelastic behavior of the media while preserving the beneficial presence of a viscous-flow behavioral component. Enhanced elastomeric characteristics enable more uniform abrasive machining. For example, in long, narrow tubes media having enhanced elastomeric character can maintain a more uniform radial pressure distribution throughout the length of the tube compared with the distribution realized when using media which does not contain a thermoplastic polymer. Extended relaxation time is particularly useful in abrasive flow machining of passageways having longer length/diameter ("L/D") dimensions. Alternatively, at low percentage inclusion and with a significant percentage of mineral oil or other liquid carrier, the thermoplastic polymer abrasive flow medium can be formulated to achieve viscosities significantly lower than those of traditional media for honing applications where a more fluid carrier is preferred. Also, by using the thermoplastic polymer alone as the carrier material, abrasive flow machining processes can be carried out in applications which cannot tolerate the presence of silicone rubber, or the silicone rubber may be enhanced by the additional presence of the at least one thermoplastic polymer. In certain embodiments, the thermoplastic polymer is added to the media in the form of discrete elastomeric particulates, which elastomeric particulates are in many cases the same size or smaller than the abrasive particles coadmixed therewith. In a particularly preferred embodiment, silicone- or polyorganosiloxane-based medium contains elastic silicone rubber particles dispersed therethrough to achieve increased relaxation times comparable to those attainable with the inclusion of a thermoplastic polymer.

Basically, a thermoplastic is any material that softens when it is heated. However, the term is commonly used to describe a substance that passes through a definite sequence of property changes as its temperature is raised. An elastomer is a polymer that is in the temperature range between its glass transition temperature and its liquefaction temperature and, in the context of this disclosure, the present thermoplastic polymers are preferably elastomers. Elastomeric properties appear when the backbone polymer bonds can readily undergo torsional motions to permit uncoiling of the chains when the material is stretched. Commercial elastomers which are too rigid for use in particular applications may be softened by the addition of plasticizers, such as phthalate esters. Other plasticizers are well known in the art. Various grades of mineral oil or paraffin oil may also be used to plasticize and/or to dilute the thermoplastic polymer media.

The use of the term "thermoplastic" herein is not intended to embrace materials which exhibit substantial fluidity or plasticity at ambient temperatures. The thermoplastic materials according to the present invention are recoverably deformable, and their recoverable deformation is strain rate independent.

Another way of appreciating the present thermoplastic component is to understand that it enables more uniform abrasion throughout the length of a larger LID passage by engineering the relaxation time of the media to match more effectively the passage dimensions and flow rate while retaining desirable viscous flow behavior. Generally, the characteristic relaxation time of the material is engineered to be comparable or large relative to the typical residence time of the material within the passage during abrasive flow processing. "Relaxation time" refers to a time measurement which quantifies the time between the initiation of stress application on a polymer and the advent of a defined amount of flow by the polymer; in other words, relaxation can be understood as a rate at which a viscous flow response relieves elastic stresses. One typical articulation of relaxation time is to identify the time it takes for an imposed shear stress to be reduced by viscous flow to an arbitrary fraction "1/e" of its initial value. While the relative relaxation time (defined as the relaxation time divided by the residence time) for optimal processing will depend on various application-specific geometric characteristics and desired results, a relative relaxation time on the order of 1 or greater should be sufficient to produce measurable, beneficial results.

A method for formulating such an improved material, to address the issue of relaxation time, thus involves dispersing thermoplastic or elastomeric polymer material within the viscoelastic material. The elastomeric material tends to contribute extremely long relaxation times while the much more flowable viscoelastic material would contribute relaxation times that can be much shorter than the residence time of the media within the passageway during abrasive flow processing. The lengthened relaxation times thus reduce or eliminate bell mouth and other disadvantages associated with the relatively shorter relaxation times typical of prior art media. Formulations may be accomplished by one of two approaches: 1) as an intimately interpenetrating second phase of thermoplastic elastic material dispersed within the base viscoelastic material, or 2) as a collection of independent, discrete, elastic particles dispersed within the base viscoelastic material.

In the first approach, an intimately interpenetrating second phase may be introduced during or following basic polymer manufacturing. Interpenetrating second phase materials may include uniformly and intimately dispersed elastic polymers such as thermoplastic elastomers introduced during melt-blend processing. Advantages of intimately interpenetrating second phase materials include a relatively strong elastic contribution. Disadvantages include the effect of turning a flowable, viscoelastic material (the base viscoelastic material) into a pseudo-flowable (or non-flowable), elastic solid, and the opportunity for behavior change in the event of a breakdown of the more solid-like components of the microstructure.

In the second and preferred approach, a collection of independent, discrete, thermoplastic elastic particles may be dispersed during or following basic polymer manufacturing. The particles must be uniformly dispersed and must remain so for successful abrasive flow processing as segregation of the elastic particles would create gradients in material properties and application effectiveness. A preferred method for ensuring a stable dispersion and avoiding segregation is to use elastic particles that have an affinity for the carrying base viscoelastic material. The dispersed elastic particles should be of similar size scale or smaller in comparison to the abrasive particles included within the abrasive media (see below). The volumetric concentration of elastomeric particles would most likely approach half or more of the volumetric concentration of abrasive particles. In some extreme cases it could exceed the volumetric concentration of abrasive particles. The advantage of the second approach compared to the first approach is that the resulting elastically-enhanced media would retain a true ability to flow in a melt-like manner versus behaving as a pseudo-flowing elastic solid.

In applications in which a silicone- or polyorganosiloxane-based viscoelastic material base is not contraindicated, surprisingly it has been found that a good particulate elastic material for inclusion is silicone-rubber in particulate form, even though silicone rubber and silicone rubber derivatives are not thermoplastic polymers. Silicone rubber particles have affinity for silicone- or polyorganosiloxane-based media due to the tendency for silicone-silicone adherence and like specific gravity, both of which contributing to the tendency for the particles to stay relatively uniformly dispersed. When silicone rubber particles are used in place of the thermoplastic polymer particles discussed elsewhere in this specification, they generally meet the same size parameters.

In any of the above approaches, the relative contributions of elastic and viscous behavior would be influenced by 1) the relative sizes of the elastic microdomains versus the abrasive particles and application geometry, and 2) the relative concentrations of the various viscoelastic, elastic, and abrasive constituents. For this reason, amounts for inclusion of thermoplastic polymers or particulates or silicone rubber particulates are not specified herein, because the desired characteristics are easily determined and implemented: the invention inheres in knowing to combine the stated constituents in the first place.

Additional preferred thermoplastic polymers for the purpose of the invention are the styrene polymers and copolymers which are gel-like (and elastomeric) in consistency at ambient temperatures (24° C.±5° C.). A specific styrene polymer useful in the present invention is the styrene-ethylene/butylene-styrene block copolymer sold under the trade name KRATON. However, this styrene block copolymer is exemplary only and virtually any other thermoplastic polymer having the same elastomeric and viscosity characteristics within the application temperature may be used. Other thermoplastic polymers include, without limitation, ethylene polymers and copolymers, polyurethane polymers and copolymers, polyvinyl polymer and copolymers, polyamide polymers and copolymers polycaprolactone polymers and copolymers, and polypropylene polymers and copolymers. The exemplary KRATON thermoplastic polymer is available, for example, as G1650 and G1651 SEBS block copolymers from Shell Kagaku.

In typical abrasive media applications, particulate or pelleted thermoplastic polymer starting material is obtained commercially and, prior to use, is liquified by elevating its temperature to between about 185° F.-375° F. The styrene-butadiene copolymers may be incorporated in the medium between 0.001-100%, more preferably 0.25-100% and most preferably between 0.5 and 100% by weight. When thermoplastic polymer is present as the base medium in less than an amount of 100% by weight, the preferred diluents are mineral oil or paraffin oil, and the mineral oil grade may be anywhere from white food grade mineral oil on down to the lower mineral oil grades. When thermoplastic polymer is incorporated as a component in a silicone-containing medium, a particularly advantageous proportion in the base medium (exclusive of abrasive) is about 20-40%, more preferably 25-35%, most preferably 30% thermoplastic polymer additive, with the balance being silicone polymer. The liquified thermoplastic polymer and silicone rubber may be combined and blended during the heating of the thermoplastic polymer: the two components do not chemically react. Alternatively, the cooled thermoplastic polymer-based material may be shredded and compounded into other abrasive machining media materials such as silicone-containing materials.

Abrasive particles may be incorporated in the present medium over a wide range of particle sizes and particle size distributions. The finely divided particles may begin from the smallest sizes available up to about a 4/6 sieve size, with the median particle size not to exceed about 0.5 cm, with larger particles to be used only in exceptional and unusual circumstances. Choice of particle size depends upon the application, and those skilled in the art of abrasive media honing can select the appropriate particle size for any given application. Particle size selection is peripheral to the present invention, which improves traditional media with either a non-silicone additive or a non-silicone thermoplastic polymer substitute altogether.

It has been observed that incorporation of styrene polymers give very different properties and viscosities depending on concentration, whether or not the thermoplastic polymer is mixed with conventional silicone. For example, a 0.75% mixture of KRATON in 99.25% white food grade mineral oil, prior to the addition of the abrasive aggregate materials, provides a highly-flowable, low viscosity liquid suitable for passing through fine machined apertures such as air intake passages for fuel injectors. Preparations containing 20% or 25% of KRATON in mineral oil are both visually and characteristically distinguishable from the 0.75% preparation. In view of the foregoing disclosure, therefore, those skilled in the art can, in a minimum number of attempts, select the viscosity and elastomeric properties required for particular applications.

It has also been observed that the presence of thermoplastic polymers in abrasive media in many cases enhances lubricant retention in the medium as contrasted with the base medium alone. This feature of the current composition and method enhances performance in various applications.

The following examples are illustrative.

Example 1

Ninety parts by weight pelleted KRATON thermoplastic polymer was shredded, heated to 200° F. and combined with 10 parts by weight automotive-grade lubricating grease. After mixing the liquified KRATON and lubricating grease but prior to cooling, equal parts by weight of the mixture and a traditional silicone rubber (polyorganosiloxane polymer) medium were manually mixed and then cooled. The resulting mixture presented enhanced elastomeric characteristics over the silicone medium alone and, upon testing with addition of abrasive particles more, achieved even distribution through internal fabricated article passages. In comparative trials, the medium provided enhanced abrasion as compared with silicone medium containing the same type and amount of abrasive particles.

Example 2

In a subsequent study, trial batches of media were prepared using six different formulations including silicone-based media, blends of silicone-based and thermoplastic polymer-based media, and thermoplastic rubber-based media. The study was executed by systematically abrasive flow machining approximately 100 identical castings using these various media formulations. The results of the study confirm that the performance characteristics attributed to the non-silicone content of the test media contrasted and complimented that of the silicone-based media content. Specifically, the non-silicone component imparted a higher degree dilatant behavior. The enhanced elasticity produced effects including more uniformly distributed abrasive work, increased flow rates at lower externally applied pressures, and the tendency preferentially to abrade the shorter radius of curved tubular passageways. The performance of the blended media benefitted from the characteristics of both the silicone and non-silicone media components and produced superior results compared with the results achieved using the silicone-based media. Furthermore, the pure non-silicone media also proved effectively to machine, with abrasive flow, the tubular passageways of the work pieces.

Depending on the specific formulation, the non-silicone component of the present media formulations can possess substantially higher degrees of elastic response than abrasive flow media formulations used to date. Various versions of the non-silicone formulations exhibit various degrees of elasticity, ability to flow, and flow rate. The complementary performance of the non-silicone and silicone components can be used in blends that result in abrasive flow machining performance tailored to application characteristics. Moreover, the thermoplastic polymer based medium used alone can accomplish uniform abrasive work in otherwise difficult applications such as along the entire length of long tubes.

Example 3

Ninety-five parts by weight of food grade white mineral oil were combined with 5 parts by weight of KRATON styrene-ethylene/butylene-styrene block copolymer at a temperature of approximately 225° F. The components were blended in a vessel provided with a manual stirring blade. One part by weight of the resulting admixture was combined with two parts by weight of aluminum oxide, 100 grain size. The resulting admixture was used in accordance with methods disclosed in previously mentioned U.S. Pat. No. 3,521,412. It should be borne in mind that the abrasive used will be varied to suit the individual application. A satisfactory abrasive for use in working on steel is silicon carbide which is readily available in standard grit sizes. An abrasive suitable for many applications is the aluminum oxide mentioned above. Other abrasives can include diamond dust, boron carbide, rouge, corundum, garnet, alundum, glass or occasionally fiber or shell materials. Commonly, the abrasive per pound of polymer base will weigh from about 0.2 pounds to about 15 pounds due to the high density of most abrasives.

Although the invention has been described with particularity above, the invention is to be limited only insofar as is set forth in the accompanying claims.

Example 4

Figure 1B:
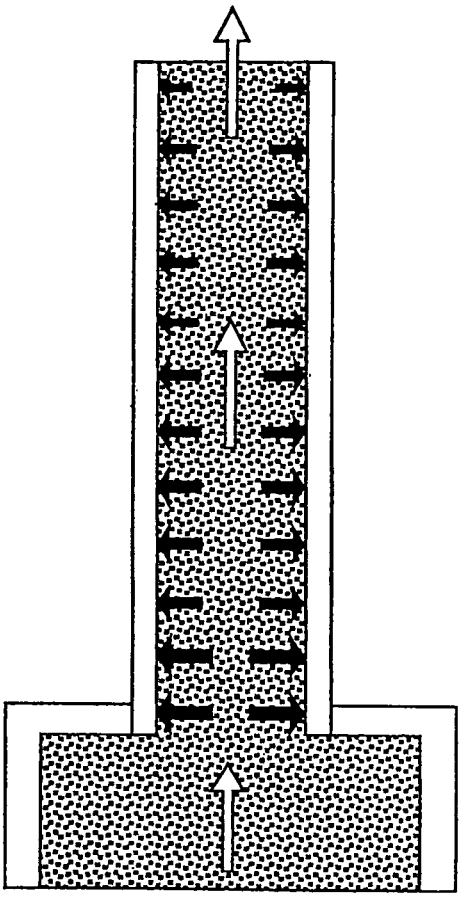
FIG. 1*b* illustrates the decreasing force exerted by traditional silicone polymer-based media on the interior length of a tube to be polished.

Quantities of medium prepared in accordance with Example 3 were passed through the interior length of a tube as shown in FIG. 1*a*. By caliper, visual inspection and surface finish measurements of the interior surface of the tube after treatment, it was confirmed that the abrasive medium according to Example 3 exerted constant radial stresses along the length of the tube resulting in uniform abrasion along the entire tube length. By contrast, a silicone polymer-based media passed through the tube represented in FIG. 1*b* was observed to exert decreasing radial stresses throughout the length of the tube, resulting in non-uniform abrasion and bell-mouth.

The invention claimed is:

1. An abrasive machining medium comprising: a quantity of abrasive particles dispersed in a viscoelastic base medium containing at least one thermoplastic polymer therein.

2. The machining medium according to claim 1 wherein said thermoplastic polymer is a styrene polymer.

3. The machining medium according to claim 2 wherein said styrene polymer is admixed with a silicone polymer.

4. The machining medium according to claim 1 wherein a diluent is present selected from the group consisting of mineral oil and paraffin oil.

5. The machining medium according to claim 1 wherein said thermoplastic polymer is present in the amount of about 0.001-100% by weight of said base medium.

6. The machining medium according to claim 1 wherein said thermoplastic polymer is present in the amount of about 0.25-100% by weight of said base medium.

7. The machining medium according to claim 1 wherein said thermoplastic polymer is present in the amount of about 0.5-100% by weight of said base medium.

8. The machining medium according to claim 2 wherein said styrene polymer is present in the amount of about 5% by weight of said base medium.

9. The machining medium according to claim 2 wherein said styrene polymer is present in the amount of about 20% by weight of said base medium.

10. The machining medium according to claim 2 wherein said styrene polymer is present in the amount of about 25% by weight of said base medium.

11. The machining medium according to claim 2 wherein said styrene polymer is present in the amount of about 40% by weight of said base medium.

12. The machining medium according to claim 2 wherein said styrene polymer softens within the temperature range of about 180°-375° F.

13. The machining medium according to claim 3 wherein said silicone polymer and said styrene polymer are admixed in about equal parts by weight.

14. The machining medium according to claim 3 wherein said silicone polymer is present in the amount of about 60-80% by weight and said styrene polymer is present in the amount of about 20-40% by weight in said base medium.

15. The machining medium according to claim 3 wherein said silicone polymer is present in the amount of about 65-75% by weight and said styrene polymer is present in the amount of about 25-35% by weight in said base medium.

16. The machining medium according to claim 3 wherein said silicone polymer is present in the amount of about 70% by weight and said styrene polymer is present in the amount of about 30% by weight in said base medium.

17. A method of making the machining medium according to claim 1 by softening a thermoplastic polymer constituent and incorporating it into the base medium recited in claim 1 in an amount sufficient to increase the relaxation time of the base medium to at least about 1.

18. A method of making the machining medium according to claim 17 by admixing the softened thermoplastic polymer constituent and melt-blending it with the base medium at the time of initial polymer manufacture of the base medium.

19. A method of making the machining medium according to claim 1 by shredding a thermoplastic polymer constituent and incorporating the discrete thermoplastic particulates thus produced into the base medium recited in claim 1 in an amount sufficient to increase the relaxation time of the base medium to at least about 1.

20. A method of making the machining medium according to claim 19 wherein the volumetric concentration of said thermoplastic particulates is half or more of the volumetric concentration of one or more abrasive particles also included in said medium.

21. The method according to claim 19 wherein said thermoplastic polymer is selected from the group consisting of styrene, ethylene, polyurethane, polyvinyl, polyamide, polycaprolactone, and polypropylene containing polymers.

22. A method of using the machining medium of claim 1 by applying it under pressure over a fabricated surface to be honed.

23. A machining medium comprising a viscoelastic base medium selected from the group consisting of a silicone polymer and a polyorganosiloxane polymer, a quantity of abrasive particles admixed therewith, and a quantity of elastic silicone rubber particles admixed with said viscoelastic base medium and said abrasive particles.

24. The machining medium according to claim 23 wherein said abrasive particles have a size of up to about 4/6 sieve and said elastic silicone rubber particles have a size of up to about 4/6 sieve.

* * * * *